US005250272A

United States Patent [19]

Knorre et al.

[11] Patent Number: 5,250,272

[45] Date of Patent: Oct. 5, 1993

[54] PROCESS FOR LEACHING PRECIOUS METALS WITH HYDROGEN-PEROXIDE AND A CYANIDE LEACHING SOLUTION

[75] Inventors: Helmut Knorre, Seligenstadt; Juergen Loroesch, Hanau-Steinheim; Steven Gos, Hanau; Mathias Stoll, Steinau-Marjoss; Annette Ziegler, Offenbach, all of Fed. Rep. of Germany

[73] Assignee: Degussa Aktiengesellschaft, Frankfurt am Main, Fed. Rep. of Germany

[21] Appl. No.: 899,588

[22] Filed: Jun. 18, 1992

Related U.S. Application Data

[63] Continuation of Ser. No. 673,868, Mar. 22, 1991, abandoned, which is a continuation of Ser. No. 402,613, Sep. 5, 1989, abandoned.

[30] Foreign Application Priority Data

Sep. 9, 1988 [DE] Fed. Rep. of Germany ..... 3830703

[51] Int. Cl.[5] ..... C01G 5/00; C01G 7/00

[52] U.S. Cl. ..... 423/31; 423/29

[58] Field of Search ..... 423/27, 29, 30, 31; 75/744

[56] References Cited

U.S. PATENT DOCUMENTS

| | | | |
|---|---|---|---|
| 732,605 | 6/1903 | Thede | 423/29 |
| 2,839,387 | 6/1958 | Burton et al. | 75/105 |
| 3,826,723 | 7/1974 | Woods et al. | 204/110 |
| 4,578,163 | 3/1986 | Kunter et al. | 204/110 |
| 4,745,953 | 7/1988 | Brison et al. | 423/29 |
| 4,816,234 | 3/1989 | Brison et al. | 75/105 |
| 4,971,625 | 11/1990 | Bahr | 423/31 |

FOREIGN PATENT DOCUMENTS

| | | | |
|---|---|---|---|
| 554947 | 3/1986 | Australia . | |
| 1221842 | 5/1987 | Canada . | |
| 0265736 | 5/1988 | European Pat. Off. . | |
| 66764 | 1/1892 | Fed. Rep. of Germany . | |
| 3637082 | 5/1988 | Fed. Rep. of Germany | 423/29 |
| 3801741 | 6/1989 | Fed. Rep. of Germany | 423/29 |

OTHER PUBLICATIONS

SME-AIME, Annual Meeting, Atlanta, Ga., Mar. 6-10, 1983, "The Use of Peroxygen Chemicals in the Heap Leaching of Gold and Silver Ores".

European Search Report in EP 89115067, EP 0358004, 1990.

Dorr, J. V. N., et al., "*Cyanidation and Concentration of Gold and Silver Ores*" 1950, Second Edition, pp. 216-218.

Woodcock, J. T., et al., "Oxygen concentrations, redox potentials, xanthate residuals, and other parameters in flotation plant pulps", in *Mineral processing and extractive metallurgy: Proceedings of the Ninth Commonwealth Mining and Metallurgical Congress 1969*, vol. 3, 1970, pp. 439-468.

(List continued on next page.)

*Primary Examiner*—Michael Lewis
*Assistant Examiner*—Steven Bos
*Attorney, Agent, or Firm*—Beveridge, DeGrandi, Weilacher & Young

[57] ABSTRACT

A process for leaching gold and silver from ores and ore concentrates is disclosed using a cyanide leaching solution and hydrogen peroxide and maintaining an oxygen concentration of 2 to 20 Mg of $O_2$/liter. In the invention, leaching takes place in the presence of decomposition catalysts and preferably the formed cyano-complexes are separated during leaching from the leach solution. Decomposition catalysts are manganese compounds, present as 0.01 to 1 mg computed as Mn/liter of barren solution, or 1 to 50 mg computed as Mn per kg of ore slurry, or they are inorganic or organic polymers or carbon. Activated charcoal is preferred and simultaneously adsorbing cyano-complexes of precious metals. The process offers lowered consumption of $H_2O_2$ and possibly cyanide and maximum gold yield in a shortened leaching time.

19 Claims, No Drawings

OTHER PUBLICATIONS

Jones, M. H., et al., "Evaluation of ion-selective electrode for control of sodium sulphide additions during laboratory floation of oxidized ores", pp. C99-C105, published Jun. 1978.

Peck, R. C., thesis entitled "Peroxide in the cyanide leaching of gold and silver ores" submitted in fulfilment of the requirements for the degree of Doctor of Philosophy at the University of Leeds, Department of Mining and Mineral Engineering, Dec. 1980.

Julian, H. F., et al., *Cyaniding Gold and Silver Ores: A Practical Treatise on the Cyanide Process*, 1904 pp. 73-76.

Jones, M. H., et al., "Perxanthates-A New Factor in the Theory and Practice of Flotation", *International J. of Mineral Processing* (1978), vol. 5, pp. 285-296.

Fraser, G. M., "Aeration Design for Gold Ore Leaching", pp. 245-256, presented at the Australlasian Institute of Mining and Metallurgy, Perth and Kalgoorlie Branches Regional Conference on "Gold-Mining, Metallurgy and Geology", Oct. 1984.

Haigh, C. J., et al., "Residue Treatment Plant Practice at Risdon, Tasmania", pp. 339-349, presented at the Australlasian Institute of Mining and Metallurgy Conference, Tasmania, May 1977.

Day, E. L., "Some factors influencing the rate of dissolution of gold in sodium cyanide solutions", *Canadian Mining Journal* (Aug. 1967), pp. 55-60.

Cathro, K. J., "The Effect of Oxygen in the Cyanide Process for Gold Recovery", pp. 181-205, Div. of Mineral Chem., Commonwealth Scientific and Ind. Res. Org., May, 1963.

Fahrenwald, A. W., et al., "Some Studies on the Gold-Dissolution Rate in Cyanide Solutions", *Engineering and Mining Journal*, vol. 140, pp. 44-46, Jan. 1949.

Mining Engineering (May 1983), pp. 517-519, vol. 35 (5).

Garcia, R. M., "The recovery of silver from photographic film: A study of the leaching reaction with cyanide solution for industrial use", *Hydrometallurgy* (1986), vol. 16, pp. 395-400.

PROCESS FOR LEACHING PRECIOUS METALS WITH HYDROGEN-PEROXIDE AND A CYANIDE LEACHING SOLUTION

This application is a continuation of Ser. No. 07/673,868, filed Mar. 22, 1991, now abandoned, which is a continuation of Ser. No. 07/402,613, filed Sept. 5, 1989, now abandoned.

INTRODUCTION AND BACKGROUND

The present invention relates to a process for leaching gold and silver from noble metal containing materials selected from ores, ore concentrates or wastes of precious metals, in particular from oxide and sulfide ores or ore concentrates, also from waste materials of earlier incomplete leaching, using an aqueous cyanide leaching solution with a pH value of 8 to 13 while adding hydrogen peroxide to the ore slurry of an agitated leach or to the barren solution of heap leach and while maintaining an oxygen concentration of 2 to 20 mg/liter in the leaching solution. By adding decomposition catalysts for hydrogen peroxide and where called for separating the formed gold- and silver-cyano-complexes from the leach solution during leaching, the demand for chemicals can be lowered and higher yield of precious metals may be achieved in less leaching time. The process of the invention has made it possible to substantially increase the economy of leaching while using hydrogen peroxide as the oxidant.

It is known to convert gold and silver by means of a cyanide aqueous solution in the presence of atmospheric oxygen into soluble cyano-complexes. This is the principle used to leach these precious metals from ores or ore concentrates or from wastes of precious metals, for instance electronics scrap. In so-called agitation leaching, the finely ground ore is dispersed in a water slurry and following the pH adjustment and addition of an aqueous cyanide solution with air gassing in cascaded, cylindrical agitation vessels or Pachuca tanks, it will then be agitated up to 48 hours and leached during the procedure. Hereafter the aqueous phase of the ore slurry shall be called the leach solution. In industry, besides the agitation leach solution, use is also made of so-called heap leaching, whereby a leach solution as a rule adjusted between a pH of 9 and 12 and containing cyanide is made to drip onto heaps of ore, atmospheric oxygen being the oxidant.

Both in heap leaching and in agitation leaching, an oxygen deficiency may arise in the ore slurry, resulting in limited gold yield and lowered rate of leaching. Attempts already have been undertaken to leach precious metal ores in the presence of oxidants other than atmospheric air. Among these approaches is the use of hydrogen peroxide.

Illustratively U.S. Pat. No. 732,605 discloses a procedure for leaching ores, wherein the ore is mixed with a metal oxide and this mixture is treated in a cyanide solution containing the hydrogen peroxide that reduces the metal oxide. The quantity of metal oxide that can be reduced, such as $Fe_2O_3$, $MnO_2$, $Ag_2O$ and HgO, should be at least equivalent to the quantity of hydrogen peroxide. The more of the metal oxide is present, the more advantageous the procedure in relation to forming nascent oxygen. Prior to leaching, the ore must be so carefully mixed with such a quantity of metal oxide that there is a content of at least 0.05%, i.e., 500 ppm. This procedure has been known since 1903 and manifestly applies only to heap leaching. It is not used today in industry because of failing to meet the requirements of commercial practice. Adding a metal oxide in the above proportions not only is uneconomical because of costs and of the time of required mixing, but also increased consumption of cyanide must be expected because the metals involved in part themselves will form cyano-complexes. Because of the presence of the admixed metal oxides in the required amounts, leaching malfunctions, for instance by passivation, can occur. Also final waste treatments to detoxify the liquids from cyanides are inevitable.

The leaching procedure known from the U.S. Pat. No. 3,826,723 using a cyanide leaching solution and hydrogen peroxide in addition to the presence of an alkali cyanide and a stabilized hydrogen peroxide solution furthermore requires a lignin sulfonate. The large quantities of chemical admixtures, especially of a NACN and $H_2O_2$, stated in this document, render an economical procedure not feasible.

The procedure of the Canadian Patent 1,221,842 is for leaching for instance gold and silver from pyrite concentrates, the leaching solution containing an alkali cyanide, an alkali carbonate and hydrogen peroxide. In the preferred mode of implementation, the leaching solution contains at least 2% by weight of sodium cyanide and at least 2% by weight of sodium carbonate and 0.6% by weight hydrogen peroxide. At these high concentrations, sodium cyanide is oxidized to a substantial extent by hydrogen peroxide according to the known cyanide detoxification using hydrogen peroxide thereby entailing additional consumption of these chemicals. In order to be able to feed back the cyanide leaching solution following the separation of the precious metal cyano-complexes into the leaching cycle, expensive purification is needed. In view alone of the high demand for chemicals, this procedure is uneconomical.

As shown by the German Patent 36 37 082, the leaching procedure employing cyanide and hydrogen peroxide may be more economical by so controlling the addition of the aqueous $H_2O_2$ solution by means of the oxygen concentration in the leaching solution that this leaching solution contains between 2 and 20 mg, preferably 7 to 13 mg of $O_2$/liter Accordingly in this known procedure, the hydrogen peroxide is added to the leaching solution or ore slurry not in one batch, but continuously or periodically in measured amounts. The lowest rates of consumption of hydrogen peroxide apply when this hydrogen peroxide is supplied as a very dilute aqueous solution, preferably with a content of 0.5 to 5, in particular 1 to 2% by weight.

However, where the procedure of the German Patent 36 37 082 has been applied in practice in gold mines, it was found that the need for sodium cyanide and hydrogen peroxide does not always meet expectations in spite of carefully metering the $H_2O_2$ and using a diluted $H_2O_2$ solution. In some cases, for instance when leaching pyritic ore concentrates and/or waste materials from earlier, incomplete leachings, the demand for chemicals was unsatisfactorily high. Manifestly this increased demand is related to the physical and chemical properties of the ores being leached.

Accordingly it is the object of the present invention to so improve the procedure of the German Patent 36 37 082 that the demand for hydrogen peroxide and where possible also that for sodium cyanide is lowered. It is furthermore desired that the demand for chemicals be made more independent of the compositions and natural variations of the ores to be leached. In addition it is highly significant to the mining industry to recover the maximum amount of precious metal which can be leached with cyanide in a shorter time than heretofore.

SUMMARY OF THE INVENTION

The above and other objects are achieved by a process for leaching gold and silver from noble metal containing materials such as ores, ore concentrates or wastes of precious metals, in particular of oxidic and sulfide ores or ore concentrates as well as waste materials from prior incomplete leachings, by employing an aqueous, cyanide leaching solution with a pH value of 8 to 13 while adding an aqueous hydrogen peroxide solution to the ore slurry of an agitation leach, or to the barren solution of a heap leach, while maintaining an oxygen concentration in the leaching solution of 2 to 20 mg/l. The process is characterized in that before or during the controlled supply of hydrogen peroxide, the ore slurry of an agitation leach is fed with a decomposition catalyst for the hydrogen peroxide. In one embodiment, di- to hepta-valent manganese compounds are used as the catalyst in amounts of 1–50 mg computed as manganese per kg of leaching solution. Organic or inorganic polymers can also be used as catalysts in amounts of 0.1 to 20 g per kg of leaching solution. Still further, powdery or granulated carbon can be used as the catalyst in amounts of 0.1–50 g per kg of leaching solution. In heap leaching, the so-called barren solution of a heap leach is fed with di- to hepta-valent manganese compounds in amounts of 0.01–1.0 mg computed as manganese per kg of barren solution to act as decomposition catalyst for the hydrogen peroxide.

A further feature of the invention resides in that the decomposition catalyst is supplied in controlled manner and is in the form of aqueous manganese-II-salts, preferably manganese sulfate, or in the form of a powdery manganese oxide from the group of Mno, $MnO_2$, $Mn_2O_3$ and $Mn_3O_4$, preferably $MnO_2$.

More particularly, a di- to hepta-valent manganese compound can be added i-n a proportion of 1 to 10 mg, computed as manganese, per kg of leach solution, to the ore slurry. Preferably a manganese-II-salt solution in a proportion of 0.05 to 0.5 mg manganese per kg of leach solution is added to the barren solution for heap leaching.

In further detail, the decomposition catalyst is an activated charcoal or an activated charcoal laden with a decomposition catalyst for hydrogen peroxide such as heavy metals or compounds of heavy metals. Typically, 1 to 20 g, preferably 5 to 20 g of an activated charcoal suited for the carbon-in-l-each procedure is used per kg of leaching solution.

During the agitation leach the formed gold- and silver-cyano-complexes are separated continuously or stepwise from the leaching solution.

It has been found to be advantageous that the separation of the Au- and Ag-cyano-complexes be performed by adsorption on powdery or granular carbon. A carbon can be used which simultaneously decomposes the hydrogen peroxide and adsorptively binds the formed Au- and Ag-cyano-complexes.

The separation of the Au- and Ag-cyano-complexes can also be performed by adsorption on an anion-exchanger or polymer-bound chelating agent. Also, the separation of the Au- and Ag-cyano-complexes is performed by evacuating the leaching solution continuously or stepwise and by replenishing it with fresh leaching solution.

It is preferred that hydrogen peroxide is supplied in controlled manner in the form of an up to 30% by weight aqueous solution.

The separation of the formed Au- and Ag-cyano-complexes during leaching is especially advantageous.

The feeding of the di- to hepta-valent manganese compounds or of the special inorganic or organic polymers or of the powdery or granulated carbon entails a decomposition of the hydrogen peroxide into oxygen and water matching the material to be leached and controlled in relation to it. Both the selection of the decomposition catalyst and thereby its activity as well as its quantity must match the system in order to achieve the lowest consumption of hydrogen peroxide and sodium cyanide with the highest yield in gold and the lowest contents of residual gold. A person skilled in the art can readily ascertain the optimal conditions by preliminary trial. The decomposition catalysts are added to the ore slurry in the so-called agitation leach, but as regards the so-called heap leaching, wherein only manganese compounds are used in very low concentrations, the catalyst is added to the so-called barren solution; that is, to the essentially ore-free leaching solution which is then caused to drip onto the heap.

The conventional agitation leach requires an industrially complex gassing of the ore slurry which frequently entails problems. To increase the oxygen content in the ore slurry and to improve leaching, suggestions already have been advanced to gas by means of molecular oxygen instead of air and/or to leach under pressure. However, the procedure is made more expensive thereby. Whereas all gassing methods require the frequently inhibited oxygen phase transition from the gaseous to the dissolved form, the oxygen produced in the decomposition of hydrogen peroxide is directly available for leaching. By selecting the kind and amount of decomposition catalysts for hydrogen peroxide, the oxygen concentration and the hydrogen peroxide concentration in the leaching solution can be matched to the particular requirements.

Different mechanisms apply when gold is dissolved in the presence of cyanide and hydrogen peroxide. To achieve optimal leaching, that i-s, high gold yield, low residual gold contents, high leaching rates at minimal chemical consumption with simple and reliable process control, it is necessary that the reagents, among which in this case are hydrogen peroxide and the oxygen arising from its dissociation, shall be present in matched quantities. This is made possible by the addition of the invention of a substance dissociating the hydrogen peroxide. Whereas leaching is accelerated when the hydrogen peroxide concentration is low, passivation will apply in the case of higher concentration.

In the course of leaching some ores, for instance oxide gold ores and waste dump materials from earlier, incomplete leaching, it was found that the leaching solution known from the procedure of the German Patent 36 37 082 does in fact exhibit the desired preferred oxygen concentration of 7 to 13 mg of $O_2$/liter but that simultaneously the hydrogen peroxide concentration is so high that cyanide is oxidized thereby. In such instances the consumption of cyanide and hydrogen peroxide becomes uneconomical. By employing the process of the invention, it is possible to lower such consumption.

It was found furthermore that in the invention, the consumption of cyanide and hydrogen peroxide also can be reduced when leaching sulfide ores, for instance pyritic and arseno-pyritic gold ores and that this reduction in amounts is substantial. This finding becomes clear from comparing the Examples of using decomposition catalysts of the invention, and those Examples which do not. To explain this effect, it is assumed that in the case of higher hydrogen peroxide concentration in the leaching solution, the sulfide will be oxidized. Some of the sulfur compounds formed thereby can react exceedingly rapidly with the cyanide and thereby contribute to the higher cyanide consumption.

In one embodiment of the invention, namely the addition of a di- to hepta-valent manganese compound, in the case of agitation leaching it is to be added in a proportion of 1–50 mg, preferably 1–10 mg. In the case of heap leaching the proportion should be 0.01–1.0 mg, preferably 0.05–0.5 mg, each time computed as manganese, in relation to 1 kg of leaching solution. This is not to be inferred from the previously known U.S. Pat. No. 732,605 as being obvious: whereas in the present invention only catalytic amounts of manganese compounds are used, the previously known procedure requires that the metal oxide reducible by the hydrogen peroxide be present in at least a stoichiometric quantity relative to hydrogen peroxide. Whereas the previously known procedure requires that only metal oxides reducible by $H_2O_2$ be carefully admixed in a proportion of at least 500 ppm to the ore prior to leaching, on the other hand the manganese compounds of the invention are added to the leaching solution or to the ore slurry before or during hydrogen peroxide addition. It is furthermore possible to use not only powdery manganese oxides from the group of MnO, $Mn_2O_3$, $Mn_3O_4$ and $MnO_2$, where $MnO_2$ is preferred, but also other, di- to hepta-valent manganese compounds such as sulfates, hydroxides, carbonates or manganates. The manganese compounds may be added, besides the powder form, as metered suspensions or preferably aqueous solutions. An aqueous manganese II sulfate solution is preferred, in particular in a concentration of 1 to 10 g of $Mn^{2+}$/liter, to adjust the manganese concentration in the leaching solution. Using a Mn-(II) salt solution is especially advantageous in heap leaching because careful dosing of Mn at the required, very low concentration is then easily possible.

"Barren solution" denotes that leaching solution which is sprayed onto the ore heap. The so-called barren solution is widely free of precious metals; however, before spraying, the pH value and the sodium cyanide concentration will be adjusted. In addition, the composition catalyst and $H_2O_2$ are added thereto in the quantities of the invention.

The use of manganese compounds of the invention is furthermore characterized relative to the other compounds cited in the U.S. Pat. No. 732,605 in that no cyano-complexes consuming cyanide are formed i-n leaching conditions and that no adsorption of heavy-metal ions added in substantial amounts resulting in degrading the leaching rate, can take place.

In the leaching solution of the invention, the manganese compounds furthermore may be replaced by organic and inorganic polymers decomposing the hydrogen peroxide and present in amounts of 0.1 to 20 g, preferably 1 to 10 g per kg of leaching solution; typically the polymer shall be insoluble in the leaching solution and is added to the ore slurry before or during $H_2O_2$ addition.

The inorganic polymers illustratively can be such known silicate polymers as zeolites, and the organic polymers illustratively may be known cation exchangers. To reinforce or to achieve the required property, namely to decompose $H_2O_2$ into water and oxygen, the polymeric substances may contain chemically or physically bound heavy metals or heavy metal compounds, preferably compounds of manganese or copper compounds. The kind of formation of decomposition catalysts bound to polymers is significant when their dissociating effect is to be excluded during cyanide detoxification.

In a preferred embodiment of the process of the invention, powdery or granular carbon can be used in amounts of 1 to 50 g, preferably 1 to 20 g per kg of leaching solution. Activated charcoal, especially i-n granular form and of the quality used in the known carbon-in-leach (CIL) or carbon-in-pulp (CIP) methods, is especially preferred. As a rule an addition of 1 to 10 g of activated charcoal per kg of leaching solution is adequate. The use of the invention of activated charcoal is especially advantageous when hydrogen peroxide is used as the oxidant in the CIL method and the formed cyano-complexes of gold and silver are adsorptively bound to the same activated charcoal.

It was found it is possible to carry out agitation leaching especially economically if during leaching the gold and silver cyano-complexes formed thereby are continuously or stepwise separated from the leaching solution. Thereby the cyano-complex concentration is kept low during leaching. The leaching duration can be shortened by the above step. This is especially interesting since heretofore progressive leaching slowed down and a high yield in gold could only be achieved after a long time or not at all. It is essential in this respect that after 4 to 8 hours of leaching, practically all of the cyanide-leachable quantity of precious metal can be recovered. The term "cyanide-leachable quantity of precious metal" means that quantity which heretofore even under the most favorable conditions of leaching, including the use of hydrogen peroxide in the presence of dissolved decomposition catalysts, as a rule could only be extracted from the ore or ore concentrate after leaching for 24 to 48 hours, and which could not be increased by extending leaching time.

The separation of the precious metal cyano-complexes can be carried out in a variety of ways: continuous or step-wise removal of part of the leaching solution during leaching and replacing the removed amount with fresh solution; i.e., with a leaching solution free or low in precious metals, thereby leading to accelerating the leaching.

An alternative to separating the Au- and Ag-cyano-complexes by removal of the mother liquor resides in adsorptively binding the complexes to anion exchangers, to polymerically bound chelating agents or to powdery or granular carbon. Adsorption to carbon is preferred. This embodiment is especially advantageous because conventional carbons act in dissociating manner on hydrogen peroxide and also exhibit high adsorption relative to Au- and Ag-cyano-complexes. Accordingly the leaching using hydrogen peroxide is carried out in the sense of the CIL technique. In this mode, and in manner known per se, reaching may take place in conventional manner in one, or in several cascaded leaching tank(s), and in the latter event the activated carbon may be made to move in counterflow. The application of the implementation mode of the invention is advantageous not only relative to ores with a high "head grade" of precious metals, but also for ores with low gold contents which can be leached with hydrogen peroxide as the oxidant and with carbon as the $H_2O_2$ dissociation catalyst and adsorbent for the Au- and Ag-cyano-complexes often more effectively and more economically than when using previously known methods.

It is in fact known to carry out the carbon-in-leach method with pure oxygen instead of air. As a rule leaching acceleration is achieved and in part also an increase in gold yield. This so-called CILO method (Publication by Kamyr Inc., Mineral Processing, Glen Falls, N.Y.) is carried out at an oxygen concentration in the range of 20 to 35 ppm in the ore slurry. Following leaching for five hours, the CILO method achieves a gold yield which upon extending the leaching to 24 hours results in a yield increase of 3 to 5%. Thus leaching is not complete after five hours; bat precisely where ores with high gold contents are concerned, such as 3 to 5% will not be foregone and therefore the leaching will be carried out longer than five hours.

In the process of the invention, on the other hand, using carbon and hydrogen peroxide, surprisingly it was possible to extract the maximum cyanide-leachable amount of gold from ores in four to eight hours. In a further stage of the leaching beyond four to eight hours, practically no increase in gold yield takes place. It was unforeseeable that in spite of the low $O_2$ concentration, a higher yield of gold could be achieved in the invention after four to eight hours than in the CILO method. The above described embodiment of the invention is suitable to leach very viscous and therefore oxygen-repellent ore slurry. The separation of carbon laden with cyano-complexes from the ore slurry takes place conventionally, for instance by sifting.

The concentration of solids in the ore slurry of agitation leaches depends on the ore properties. As a rule the concentrations of solids are in the range of about 20–60% by weight.

In the invention, aqueous hydrogen peroxide is used in concentrations up to 70% by weight. Preferably solutions with a content up to 30% by weight are used. In the previously known procedure of the German Patent 36 37 082, hydrogen peroxide most of the time must be fed in controlled manner as a very dilute aqueous solution, in particular from 1 to 2% by weight, requiring high dilution. The present invention enables direct use of highly concentrated, or moderately dilute hydrogen peroxide.

Another advantage of the invention is that the $O_2$ and $H_2O_2$ concentrations most advantageous for leaching are adjusted in the leaching solutions much more rapidly than when using hydrogen peroxide without the decomposition catalysts of the invention; as result the time of leaching is shortened.

Leaching takes place at pH value of 8 to 13, preferably 9 to 12. To adjust the pH, preferably alkali or earth alkali hydroxides or oxides are used, in the same manner as in conventional leaching. The cyanides used are alkali or earth-alkali- cyanides. Typically the cyanide concentration in the leaching solution is 0.01 to 0.1% by weight, however lower and higher concentrations also may be used.

The hydrogen peroxide is added to the ore slurry or to the leaching solution continuously or periodically in such a way that an oxygen concentration of 2 to 20 mg of $O_2$/liter, preferably 7 to 13 mg of $O_2$/liter, shall be set and maintained during leaching. The oxygen concentration is measured for instance by an oxygen electrode and the deviation of the 02 value from the reference value is used as an error signal in controlling the hydrogen peroxide.

The Examples below show how the process of the invention lower the consumption of chemicals compared with the procedure of the German Patent 36 37 082 and how simultaneously the maximum gold yield is achieved in less time.

Detailed Description of the Invention

EXAMPLE 1

Waste material containing gold and from an earlier, incomplete leaching was leached continuously in three cascaded agitation vessels each of 1 $m^3$ capacity. In the first vessel, the ore suspension with a solids content of about 55% by weight was adjusted for a pH of 10.5 by adding milk of lime. The additions of "black cyanide" and the hydrogen peroxide, which was used as a 1.33% by weight aqueous solution, took place in a way that the oxygen concentration during the 9-hour dwell time in the second vessel remained constant. Each time a cyanide concentration corresponding to 0.04% by weight of NaCN was set in the leach solution. The second vessel also was supplied with the manganese compounds of the invention in the form of aqueous $MnSO_4$ solutions or as powdery $MnO_2$. The dwell time in the third vessel also was nine hours and leaching was completed therein.

Table 1 shows the leaching results from three samples of different compositions but from the same mine. It shows the gold content of the sample used (head grade), the yield in % and the consumptions of sodium cyanide and hydrogen peroxide referred to 1 ton of the waste material being used. Leaching took place at an $O_2$ concentration of 8 and 12 mg/liter, each time with and without the addition of the invention of the manganese-II- or manganese-IV-compound (the Mn concentration stated in mg/kg always refers to the leaching solution). In every case it was possible to lower the consumption of NACN and H202 by means of the process of the invention.

EXAMPLES 2 TO 4

Pretreated pyrite concentrations are leached using black cyanide and hydrogen peroxide while keeping constant an oxygen concentration of 12 mg/l in accordance with the German Patent 36 37 082. In Example 2, no Mn compound of the invention was added, whereas in Example 3 manganese-IIsulfate and in Example 4 manganese dioxide were added. A cyanide concentration corresponding to 1.5% by weight NaCN was set in each case in the leaching solution. The solid contents each time were about 25% by weight, the manganese-(II)—or—(IV)—concentrations in Examples 3 and 4, respectively, were each 10 mg/kg referred to the ore slurry. The gold yield and the consumptions of sodium cyanide and hydrogen peroxide, added as 5% aqueous solution, are shown in Table 2 as a function of leaching time.

TABLE 1

| Sample # | $O_2$ Concentration (mg/kg) | Mn-II- and Mn-IV - Concentration (mg/kg) | Au content (head grade) (g Au/t) | Au Leaching Yield | Cyanide Consumption (kg NaCN/t) | $H_2O_2$ Consumption (kg H2O2) (70 wt.-%)/t) |
|---|---|---|---|---|---|---|
| 1 | 8 | — | 0.663 | 65.3 | 0.178 | 0.348 |
| | 8 | 7 ppm as Mn(II) | 0.798 | 67.0 | 0.164 | 0.191 |
| 2 | 12 | — | 0.404 | 35.6 | 0.163 | 0.639 |
| | 12 | 2,3 ppm as Mn(II) | 0.441 | 50.1 | 0.155 | 0.425 |
| 3 | 12 | — | 0.333 | 37 | 0.159 | 0.513 |
| | 12 | 7 ppm as Mn(IV) | 0.349 | 37 | 0.153 | 0.440 |

TABLE 2

| | Example 2 no Mn addition | Example 3 Mn(II) addition | Example 4 Mn(IV) addition |
|---|---|---|---|
| Gold content (g Au/t) | 146.0 | 154.8 | 141.1 |
| Gold yield (%) after so many h leaching | | | |
| 1 | 64.9 | 69.3 | 62.8 |
| 4 | 84.7 | 86.4 | 80.4 |
| 9 | 89.9 | 90.6 | 87.5 |
| 24 | 94.0 | 93.2 | 93.0 |
| $H_2O_2$ Consumption (Kg $H_2O_2$ (70% by weight per ton of pyrite concentrate after so many h of leaching | | | |
| 1 | 4.42 | 2.91 | 1.78 |
| 4 | 5.03 | 4.26 | 2.70 |
| 9 | 8.52 | 5.51 | 4.72 |
| 24 | 11.80 | 8.92 | 8.45 |
| NaCN— Consumption (kg NaCN (100%)/ton of pyrite concentration after so many hours of leaching | | | |
| 1 | 4.95 | 3.58 | 4.16 |
| 4 | 7.63 | 4.89 | 5.82 |
| 9 | 8.13 | 5.75 | 7.65 |
| 24 | 9.66 | 7.82 | 9.48 |

Surprisingly the consumption of hydrogen peroxide in the presence of added manganese dioxide was lower, especially in the first nine hours, than when adding manganese-II-sulfate. On the other hand, manganese-II-sulfate caused a lower consumption of sodium cyanide than manganese dioxide.

The pretreated pyrite concentrate was a concentrate biologically preoxidized using Thiobacillus ferrooxidans.

EXAMPLE 5

A substantially oxidized gold ore was subjected to heap leaching. The leach solution (barren solution) fed to the heap contained 0.03% by weight sodium cyanide and its pH value was 10.5.

It was possible to increase the $O_2$ concentration in the barren solution only by about 2 ppm when adding hydrogen peroxide to it in an amount corresponding to 0.05% by weight when in the absence of a manganese compound of the invention. The solution leaving the heap (pregnant solution) however showed $O_2$ values that had hardly changed (about 5 ppm).

Other conditions remaining the same, when 0.1 mg Mn(II)/kg of leach solution was added to the barren solution as manganese solution, the $O_2$ concentration in the incoming leach solution could be raised from 6 mg/l to 20 mg/l and in the outgoing solution from 5 to 8–12 mg/l. Accordingly hydrogen peroxide is decomposed as needed. If now 2.5 mg of Mn(II)/kg of leach solution are added, then the hydrogen peroxide decomposes practically entirely in the upper layer of the heap, degassing taking place and an oxygen deficit, or a hydrogen-peroxide deficit remains in most of the heap.

EXAMPLES 6 AND 7

Pyrite concentrates pretreated by bio-oxidation in the manner of Examples 2 through 4 were leached using sodium cyanide and hydrogen peroxide while maintaining constant an oxygen concentration of 12 mg/l in the manner of the German Patent 36 37 802, Example 6 lacked a decomposition catalyst whereas palladium-laden activated charcoal was added to Example 7. In each leaching solution the cyanide concentration was set at 0.33% by weight of NaCN. The solid contents were 25%. Seven g of activated-charcoal/kg of ore suspension, with the activated charcoal being laden with 5% palladium, were added to Example 7. The consumption of sodium cyanide and hydrogen peroxide, in the form of a 1% by weight aqueous solution, is shown in Table 3 as a function of the leaching time. Surprisingly, the consumption both of hydrogen peroxide and of sodium cyanide was substantially less in the presence of the decomposition catalyst.

EXAMPLE 8

A gravity concentrate from a south african mine of which the head-grade contained 871.2 g of Au per ton of ore was leached. The ore slurry contained 16.7% by weight solids; the pH was adjusted to 11 and the initial NaCN concentration was set at 10 g/l. Leaching took place in an agitation vessel with addition of a 5% by weight $H_2O_2$ solution and while maintaining an $O_2$ level of 18 ppm. Table 4 shows the gold yields as a function of leaching time, Test (a) taking place without exchanging the leaching solution whereas in Test (b), the supernatant leaching solution following the ore sedimentation was totally exchanged after 1, 2, 4 and 8 hours.

TABLE 3

| | Example 6 no decomposition catalyst | Example 7 with Pd-laden activated charcoal |
|---|---|---|
| $H_2O_2$— consumption (Kg $H_2O_2$ (70% by weight)/ton of ore after so many hours of leaching | | |
| 1 | 0.65 | 0.48 |
| 2 | 1.01 | 0.76 |
| 4 | 1.76 | 1.37 |
| 6 | 2.70 | 1.78 |
| NaCN— consumption (Kg NaCN (100%)/ton of ore after so many hours of leaching | | |
| 1 | 2.40 | 2.34 |
| 2 | 2.85 | 2.91 |
| 4 | 4.17 | 3.75 |
| 6 | 4.75 | 3.84 |

TABLE 4

| | % gold extraction with time (h) | | | | |
|---|---|---|---|---|---|
| | 1 | 2 | 4 | 8 | 24 |
| (a) no exchange | 46.5 | 50.3 | 56.1 | 65.7 | 99.2 |
| (b) with exchange | 52.4 | 74.2 | 95.1 | 99.1 | 99. |

Example 8, carried out in the absence of a decomposition catalyst, shows the effectiveness of each exchange.

EXAMPLE 9

The ore of Example 9 was leached under the same conditions except for omission of the leach exchange but in the presence of 50 g granulated activated charcoal acting as decomposition catalyst and adsorber for the gold complex. Table 5 shows the time-dependent gold yields, the consumption of $H_2O_2$ and of cyanide, leaching taking place in (a) with an $O_2$ concentration of 18 ppm and in (b) of 12 ppm.

TABLE 5

| | Gold extraction (%) | | | | |
|---|---|---|---|---|---|
| | 1 | 2 | 4 | 8 | 24 |
| (a) 18 ppm $O_2$ | 97.4 | 98.7 | 99.2 | 99.5 | 99.6 |
| (b) 12 ppm $O_2$ | 92.7 | 97.1 | 99.6 | 99.6 | 99.6 |
| Comparison with Example 8(a) | 46.5 | 50.3 | 56.1 | 65.7 | 99.2 |
| Cyanide consumption (2 g/ton of ore) | | | | | |
| (a) 18 ppm $O_2$ | 8.5 | 11.1 | 13.2 | 25.6 | 42.4 |
| (b) 12 ppm $O_2$ | 6.5 | 7.3 | 9.9 | 14.7 | 30.7 |
| $H_2O_2$ Consumption (kg 70%/ton of ore) | | | | | |
| (a) 18 ppm $O_2$ | 7.1 | 11.9 | 18.0 | 45.0 | 95.8 |
| (b) 12 ppm $O_2$ | 3.2 | 4.9 | 8.6 | 14.1 | 37.0 |

EXAMPLE 10

A South African gold ore was leached once conventionally by the carbon-in-leach technique (a) and once in the manner of the invention (b) using the same carbon as in (a). The solid content was 50%, the pH was set at 11 using CaO; the NaCN concentration was 0.05% by weight, and the head grade was 2.1 g Au per ton of ore; 20 g of activated charcoal were added per liter of slurry.

In (a) the $O_2$ value in the slurry slowly rises from 1–2 ppm to 8 ppm. In (b), an $O_2$ concentration of 12 ppm was set by adding 1% $H_2O_2$ solution. Table 6 shows the time-dependent gold yield:

TABLE 6

| | % gold yield as a function of time (h) | | | | |
|---|---|---|---|---|---|
| | 1 | 2 | 4 | 8 | 24 |
| (a) CIL | 56 | 80 | 88 | 97 | 99 |
| (b) $H_2O_2$/CIL | 81 | 90 | 99 | 99 | 99 |

EXAMPLE 11

This test compares leaching using $H_2O_2$ without activated charcoal, namely (a), with leaching including activated charcoal, namely (b).

South-African waste material is used, with a head-grade of 1.33 g per ton of ore; the NaCN concentration is 0.05% by weight, the solid contents is 50% by weight and the pH is 11. An $O_2$ level of 12 ppm was set in (a) and in (b) using 1% by weight aqueous $H_2O_2$ solution, and this level was maintained. In test 11 (b), 20 g of carbon per liter of slurry were used.

TABLE 7

| | % gold yield as a function of time (h) | | | | |
|---|---|---|---|---|---|
| | 1 | 2 | 4 | 8 | 24 |
| (a) only $H_2O_2$ | 70 | 72 | 81 | 88 | 89 |
| (b) $H_2O_2$ + carbon | 80 | 83 | 92 | 93 | 93 |

After about four hours and using the process of the invention, (b), the gold yield is 92–93% and therefore about 4% more gold is extracted than is achieved in 24 h using $H_2O_2$ but without carbon under otherwise equal conditions. Shortening the leaching time entails a lowering in the consumption of chemicals.

Further variations and modifications of the foregoing will be apparent to those skilled in the art and are intended to be encompassed by the claims appended hereto.

German priority application P 38 30 703.0-24 is relied on and incorporated herein.

We claim:

1. A process for agitation leaching of gold and silver from a noble metal containing material selected form the group consisting of ores, ore concentrates, wastes of precious metals, and waste materials of prior incomplete leachings, consisting essentially of forming a leaching slurry from said noble metal containing material and an aqueous cyanide leach solution having a pH of 8 to 13, adding to said slurry before or during leaching a catalyst capable of decomposing hydrogen peroxide into oxygen and water, said catalyst being selected from the group consisting of (1) 0.1 to 50 g powdery or granular activated carbon per kg of leach solution;

(2) 0.1 to 20 g of organic polymeric cation exchangers which contain a heavy metal, which is a decomposition catalyst for hydrogen peroxide, bound thereto per kg of leach solution; and (3) 0.1 to 20 g of inorganic silicate polymers which contain a heavy metal, which is a decomposition catalyst for hydrogen peroxide, bound thereto per kg of leach solution;

adding an aqueous hydrogen peroxide solution to said slurry in such a way as to set and maintain an oxygen concentration in said slurry in the range of 2 to 20 mg 02 per liter of the leach solution.

2. The process according to claim 1, wherein the said material is an oxidic or sulfide ore or ore concentrate.

3. The process according to claim 1, wherein the catalyst is metered and supplied into said slurry in the form of an aqueous solution.

4. The process according to claim 1, wherein a divalent manganese compound is added into said slurry in a proportion of 1 to 10 mg, computed as manganese, per kg of leach solution.

5. The process according to claim 1, wherein gold- and silver-cyano-complexes formed by treating said noble metal containing material with said leaching solution are separated 6. The process according to claim 5, wherein the Au- and Ag-cyano-complexes are separated by adsorption on powdery or granular activated carbon.

7. The process according to claim 6, wherein a carbon is used which simultaneously decomposes the hydrogen peroxide and adsorptively binds the formed Au- and Ag-cyano-complexes.

8. The process according to claim 5, wherein the Au- and Ag-cyano-complexes are separated by adsorption on an anion-exchanger.

9. The process according to claim 5, wherein the Au- and Ag-cyano-complexes are separated by removing the leaching solution continuously or stepwise and by replenishing it with fresh leaching solution.

10. The process according to claim 1, wherein hydrogen peroxide is supplied in the form of up to 30% by weight aqueous solution.

11. The process according to claim 1, wherein said aqueous cyanide leach solution has a pH of 9 to 12.

12. The process according to claim 1, wherein said powdery or granular activated carbon contains a heavy metal or heavy metal compound, which is a decomposition catalyst for hydrogen peroxide, adsorbed thereon.

13. The process according to claim 12, wherein said heavy metal is selected from the group consisting of Mn, Cu and Pd.

14. The process according to claim 12, wherein said heavy metal compound is selected from the group consisting of Mn, Cu and Pd compounds.

15. a process for heap leaching gold and silver from a noble metal containing material selected from the group consisting of ores, ore concentrates, wastes of previous metals, and waste materials of prior incomplete leachings, comprising treating said noble metal containing material with an aqueous cyanide leach solution having a pH of 8 to 13 which is a barren solution, adding to said barren solution a manganese (II)—compound in a quantity of 0.05 to 0.5 mg computed as manganese per kg of barren solution and adding an aqueous hydrogen peroxide solution to said barren solution in such a quantity as to set an oxygen concentration in said barren solution in the range of 2 to 20 mg/liter.

16. The process according to claim 15, wherein the said noble metal containing material is an oxidic or sulfide ore or ore concentrate.

17. The process according to claim 15, wherein the catalyst is metered and supplied in the form of an aqueous solution of a manganese-II-salt.

18. The process according to claim 17, wherein said catalyst is manganese sulfate.

19. The process according to claim 15, wherein hydrogen peroxide is supplied in the form of up to 30% by weight aqueous solution.

* * * * *